US007820946B2

(12) United States Patent
Woodfill et al.

(10) Patent No.: US 7,820,946 B2
(45) Date of Patent: Oct. 26, 2010

(54) HEATED HYDRATION SYSTEM

(75) Inventors: Wade Woodfill, Oakland, CA (US); Tae Kim, San Francisco, CA (US); Jeffrey Nash, Oakland, CA (US)

(73) Assignee: The North Face Apparel Corp., Wilmington, DE (US)

( * ) Notice: Subject to any disclaimer, the term of this patent is extended or adjusted under 35 U.S.C. 154(b) by 1043 days.

(21) Appl. No.: 11/582,487

(22) Filed: Oct. 18, 2006

(65) Prior Publication Data

US 2007/0084844 A1 Apr. 19, 2007

Related U.S. Application Data

(60) Provisional application No. 60/727,499, filed on Oct. 18, 2005.

(51) Int. Cl.
*H05B 3/00* (2006.01)

(52) U.S. Cl. ..... 219/214; 219/201; 219/522

(58) Field of Classification Search ..... 219/214, 219/522, 529, 535; 224/630
See application file for complete search history.

(56) References Cited

U.S. PATENT DOCUMENTS

| | | | | |
|---|---|---|---|---|
| 4,553,023 | A * | 11/1985 | Jameson et al. | 392/472 |
| 4,930,543 | A | 6/1990 | Zuiches | |
| 5,245,693 | A * | 9/1993 | Ford et al. | 392/470 |
| 5,975,387 | A | 11/1999 | Gleason et al. | |
| 6,142,974 | A | 11/2000 | Kistner et al. | |
| 6,756,573 | B2 * | 6/2004 | Cornell | 219/541 |
| 2005/0029313 | A1 | 2/2005 | Robins et al. | |
| 2006/0151534 | A1 * | 7/2006 | Mares | 222/175 |

* cited by examiner

*Primary Examiner*—Tu B Hoang
*Assistant Examiner*—Vinod D Patel
(74) *Attorney, Agent, or Firm*—Kenyon & Kenyon LLP

(57) ABSTRACT

A method and portable hydration system can include a conduit coupled to a bite valve and a reservoir. The conduit and the bite valve facilitate human consumption of fluid in the reservoir. The system may also include an active heating assembly to prevent the fluid from freezing while in the conduit and the bite valve. The active heating assembly may include a temperature sensor to detect the temperature of the conduit, a heating element to heat the conduit and a controller coupled to the temperature sensor and the heating element to control heating of the conduit.

14 Claims, 7 Drawing Sheets

44

140
40
42

144
142

142
148
146

HEATED HYDRATION SYSTEM

This Non-Provisional Application claims the benefit of Provisional Application Ser. No. 60/727,499 filed on Oct. 18, 2006.

BACKGROUND

1. Technical Field

Embodiments of the invention generally relate to hydration packs. More particularly, embodiments relate to heated hydration systems.

2. Discussion

Staying hydrated during endurance-based sporting activities such as running, cycling, rock climbing, skiing and hiking has long been an issue of concern among athletes. Indeed, it is well documented that the failure to replace bodily fluids during exercise can negatively affect athletic performance and potentially lead to serious health problems.

Recent strides to facilitate the consumption of fluids during exercise have led to the development and the popularity of hydration packs, which enable the individual to periodically consume fluid from a sack that can be mounted on the individual's back. In conventional configurations, one end of a tube is attached to a reservoir containing the fluid, where the individual drinks from the other end of the tube in a manner not unlike the process of drinking from a straw. While these packs can be suitable under certain circumstances, there still remains considerable room for improvement.

For example, one challenge is that in cold weather environments, the fluid may freeze within the tube, rendering the pack unusable. This is due in large part to the relatively narrow interior of the tube, which makes it much more susceptible to freezing. Fluid freezing can occur even more often in situations where the individual drinks from the tube relatively infrequently.

BRIEF DESCRIPTION OF THE DRAWINGS

The various advantages of the embodiments of the present invention will become apparent to one skilled in the art by reading the following specification and appended claims, and by referencing the following drawings, in which:

DETAILED DESCRIPTION

According to an embodiment of the invention, a portable hydration system includes a conduit coupled to a valve and a reservoir. The conduit and the valve facilitate human consumption of fluid in the reservoir. The system also includes an active heating assembly to prevent the fluid from freezing while in the conduit and the valve. The active heating assembly may include a temperature sensor to detect the temperature of the conduit and/or the fluid in the conduit, a heating element to heat the conduit and a controller coupled to the temperature sensor and the heating element to control heating of the conduit. In one example, the controller has a microprocessor and a power source such as a direct current (DC) power source. In another example, the active heating assembly may include a chemical pack solution that generates heat when manipulated or broken. In either example, the active heating assembly can convert one form of energy into heat rather than merely attempting to trap in preexisting heat with insulation.

Figures 1A, 1B:
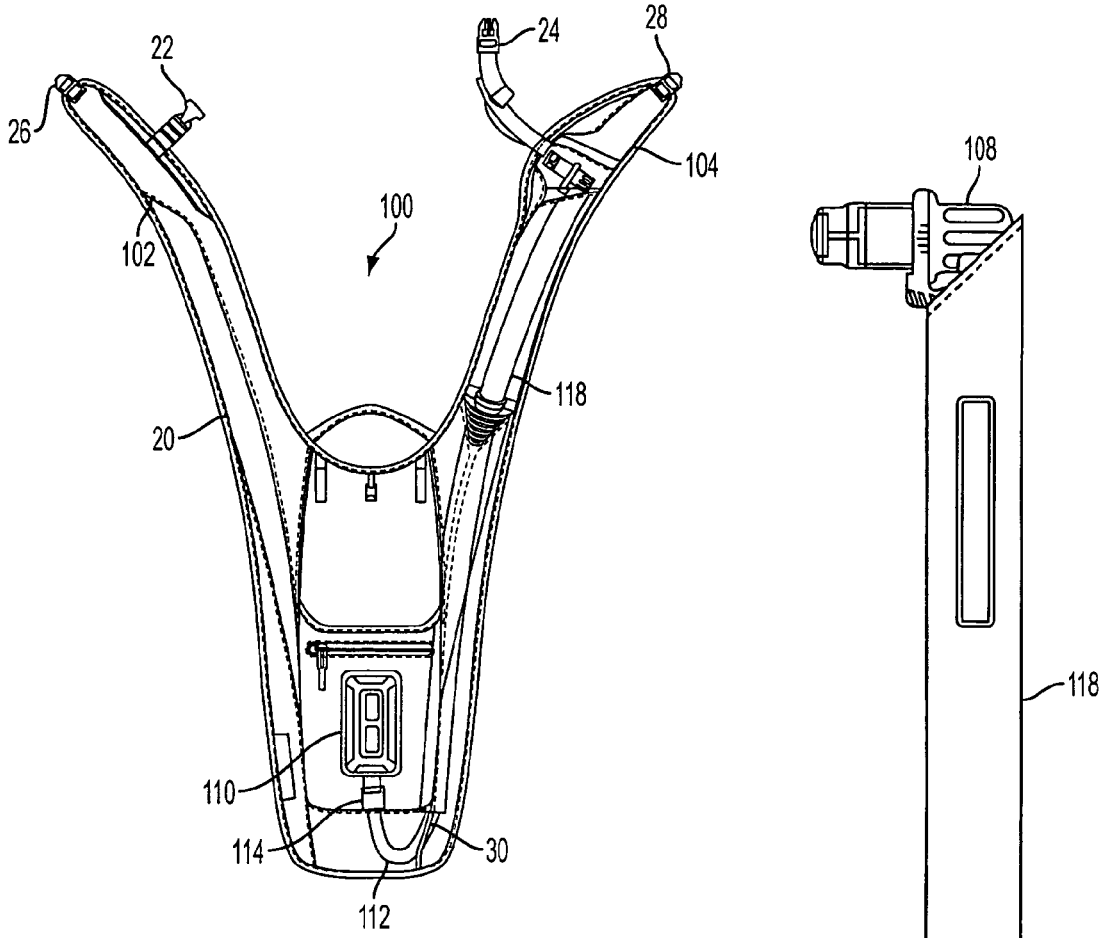
FIG. 1A is a cutout view of an example of a hydration pack according to an embodiment of the invention.
FIG. 1B is an enlarged view of an example of a hydration pack heating system according to an embodiment of the invention.

Turning now to FIGS. 1A and 1B, one example of a portable hydration system 100 is shown. The hydration system 100 can use a carrying device 20 to carry a fluid such as water, electrolyte replacement beverage, juice, etc., and may be used by athletes or other individuals to remain hydrated. The illustrated carrying device 20 of the hydration system 100 has a pair of shoulder straps 102, 104, and is therefore configured to be worn on the back of the individual. The shoulder straps 102, 104 may include male/female snaps 22, 24, respectively, wherein the snaps 22, 24 may be coupled to one another to provide the wearer of the hydration system 100 with a "snug" fit. The shoulder straps 102, 104 may also include tie buckles, 26, 28, which may be mated with corresponding ties (not shown) on the carrying device 20 to further improve the fit. Other mounting and/or carrying techniques such as a single strap or waist-mounted configuration may also be used.

The system 100 can also include a conduit 106 that is coupled to a reservoir (not shown) to facilitate human consumption of fluid in the reservoir. In the illustrated example, a free end of the conduit 106 includes a bite valve 108, which the individual can insert in his or her mouth, where biting the valve 108 enables the fluid to be drawn through the conduit 106. One of the shoulder straps can be used to route the free end of the conduit 106 to the front of the individual for ease of use. For example, the shoulder strap 104 is shown as having a passageway and/or pocket for routing the conduit 106.

The illustrated hydration system 100 also includes an active heating assembly to prevent the fluid from freezing while in the conduit 106 and the bite valve 108. Accordingly, the hydration system 100 is particularly useful in cold environments. The active heating assembly can include a temperature sensor (not shown) coupled to the conduit 106 to sense the temperature of the conduit 106, a heating element (not shown) such as a Nichrome heating wire or other resistive material embedded in a substrate such as Mylar to heat the conduit 106 and a controller 110 coupled to the temperature sensor and the heating element to control heating of the fluid in the conduit 106 and/or bite valve 108. In the embodiment shown, the controller 110 is coupled to the heating element via a connector 114 and a copper wire pair that is contained within a fabric strip 112. The controller 110 may be contained within a molded plastic electronics case 116 along with a power source such as a DC power source (e.g., four AA batteries).

The conduit 106 may also be insulated by an insulation sleeve 118, including, for example, Polyguard. The sleeve 118 can be sewn with the heating element disposed between the inner and outer layers of the sleeve 118 or the heating element may be disposed within the inner diameter of the sleeve 118 and directly in contact with the conduit 106. The illustrated embodiment also has a web tether 30 to fasten the insulation sleeve 118 into a bottom interior seam of the carrying device 20. In one example, the web tether 30 is approximately 10 cm long with about a 15 mm diameter.

Figure 2:
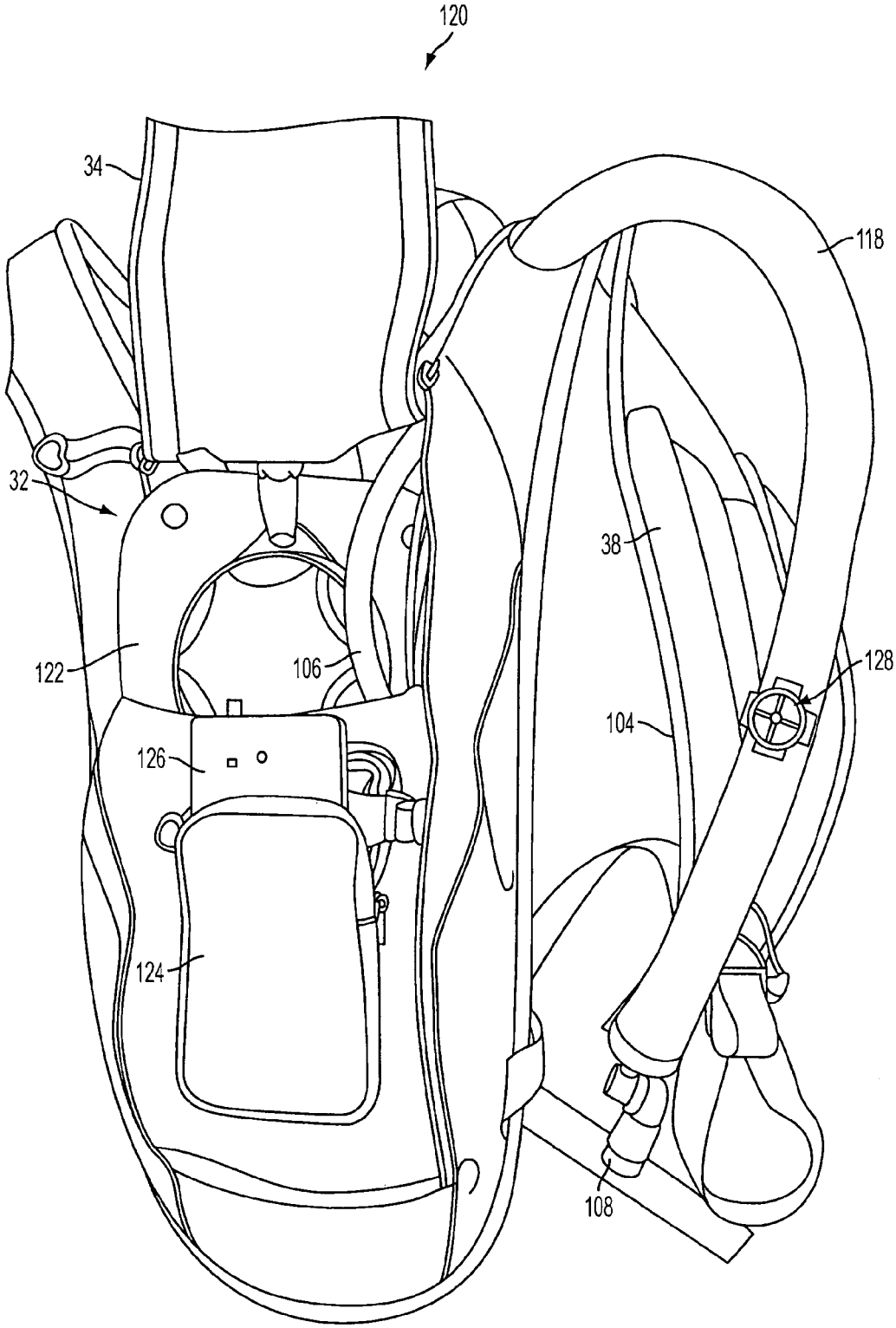
FIG. 2 is a diagram of an example of a hydration pack according to an embodiment of the invention.

FIG. 2 shows a fully-constructed portable hydration system 120 in which a reservoir 122 containing fluid can be seen more clearly. The shoulder strap 104 can have a zippered passageway 38 that routes the valve 108 to the front portion of the hydration system 120. The illustrated reservoir 122 is contained within a protective pocket 32 having a zippered flap 34, which is shown in the open state. The protective pocket 32 may also be heated. It can be seen that a controller 126 can also be inserted into a smaller protective pocket 124. The hydration system 120 may also have a conduit 106 extending through an inner diameter of an insulation sleeve 118 as already discussed. In this example, the system 120 also includes an indicator 128, which may be a multi-colored LED, where the indicator 128 can inform the individual of various status conditions of the system 120. For example the indicator 128 could be used to relay the amount of remaining battery life. An example of possible functional settings for the indicator 128 is shown below in Table 1.

TABLE 1

| LED | Status |
|---|---|
| OFF | System OFF<br>Heat OFF |
| GREEN<br>10 blinks per second | System ON<br>Heat OFF |
| RED<br>10 blinks per second | System ON<br>Heat ON |
| RED<br>14 blinks per second | Low Battery<br>Warning |

Figure 3B:
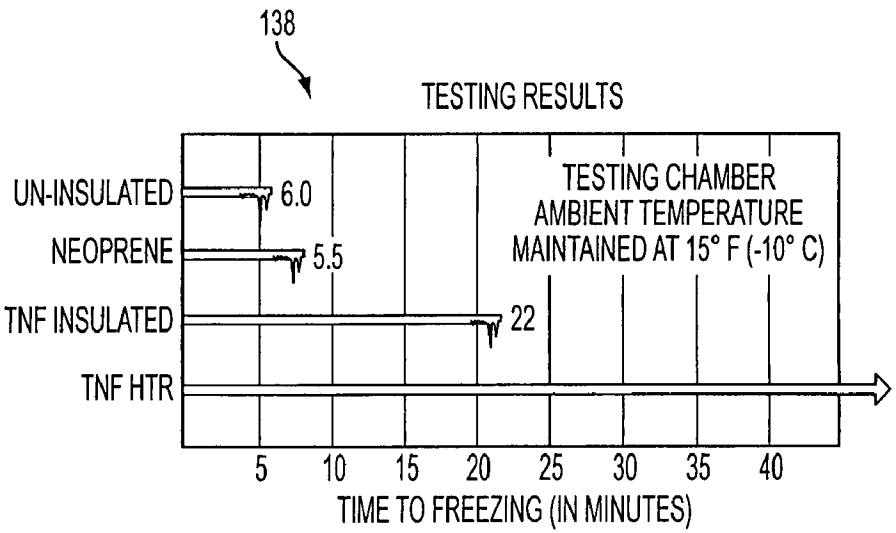
FIG. 3B is a chart of an example of test results according to an embodiment of the invention.
Figure 3A:
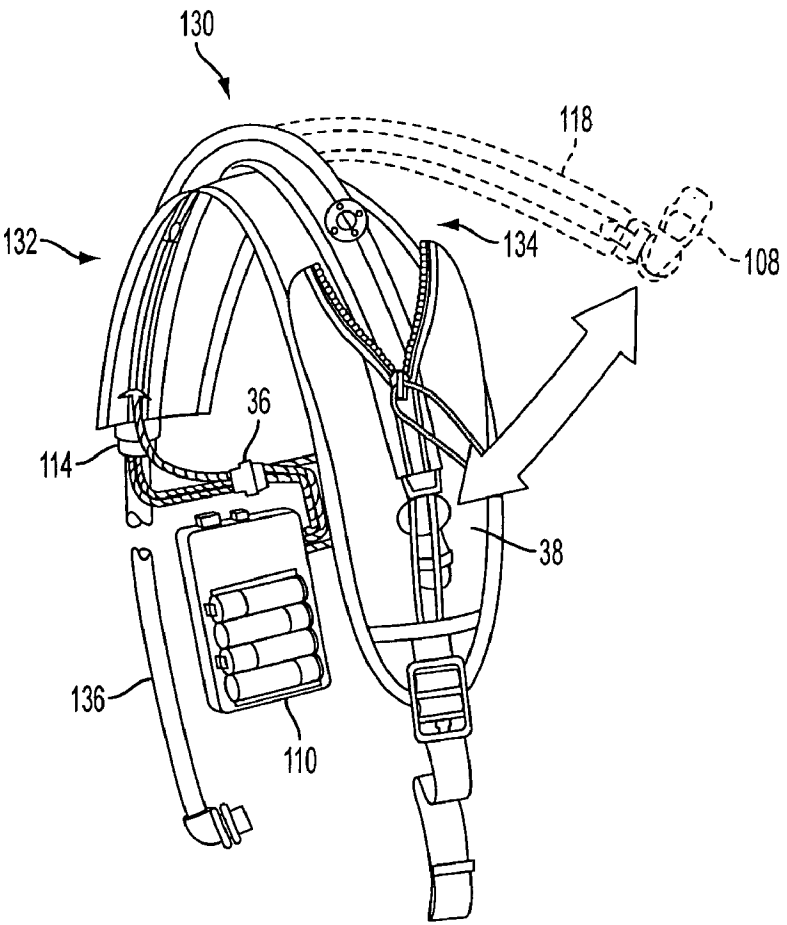
FIG. 3A is a perspective view of an example of a fluid supply portion of a hydration pack according to an embodiment of the invention.
Figures 4A, 4B, 4C, 4D, 5:
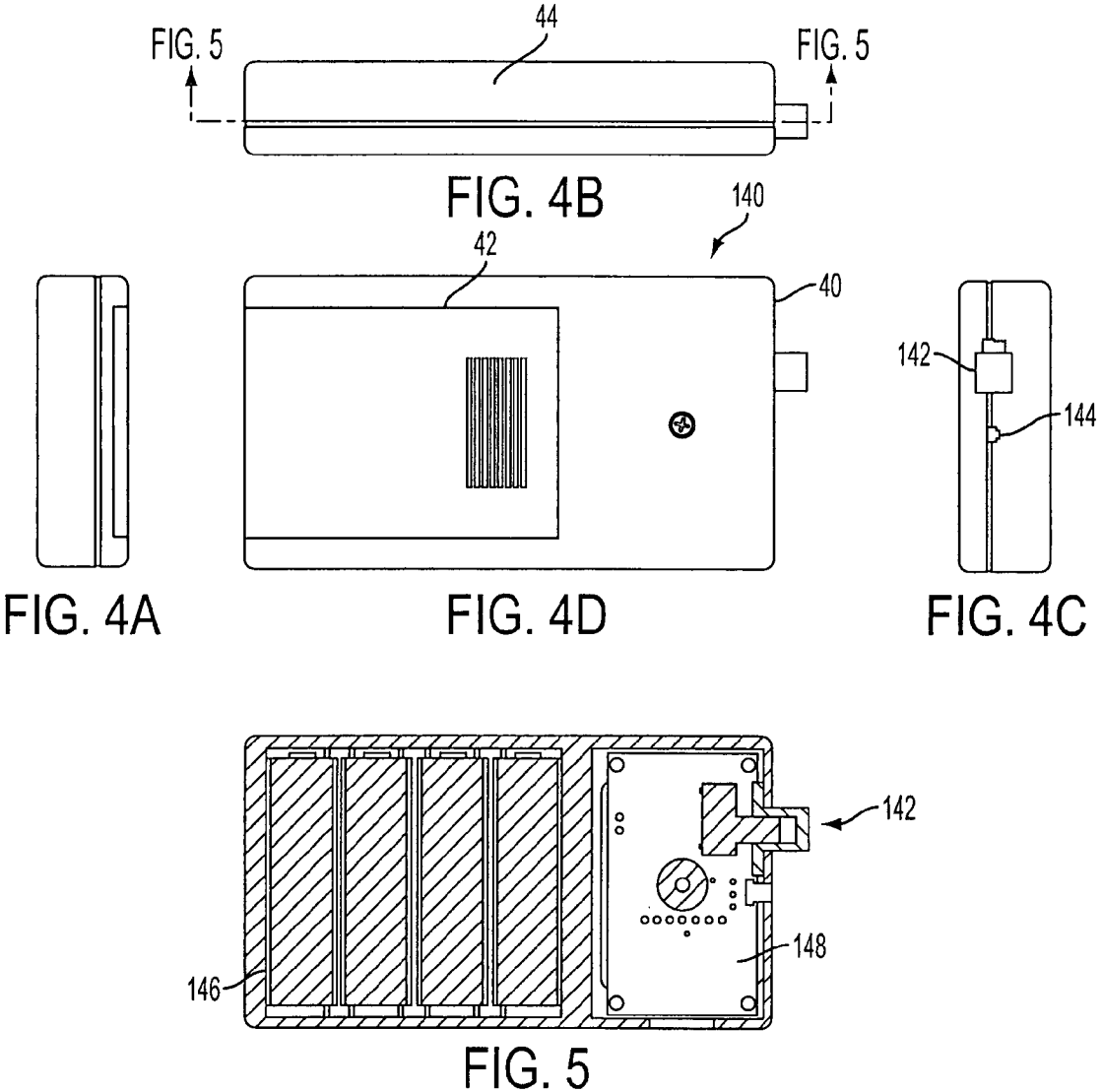
FIGS. 4A-4D are of multiple views of an example of a battery pack according to an embodiment of the invention.
FIG. 5 is a sectional view taken along lines 5-5 in FIG. 4.

FIG. 3A shows yet another example of a portable hydration system 130 in which the operation of the temperature sensor 132 and the indicator 134 can be seen more clearly. In particular, a portion of the sleeve 118, heating element (not shown) and conduit 136 is disposed within the passageway 38 and the illustrated temperature sensor 132 is disposed adjacent to and/or coupled to the outer surface of the conduit 136 in order to obtain a temperature measurement. The temperature sensor 132 may alternatively be disposed within the conduit 106 or elsewhere in the system 130, although the illustrated placement may be the most effective and practical. A controller 110 is removably coupled to the heating element (not shown) via an electrical connector 114, as already discussed. The controller 110 may also be removably coupled to the temperature sensor 132 and the indicator 128 via the connector 114 and/or an electrical connector 36. Chart 138 demonstrates example test results that show the effectiveness of the system 130. For example, at a certain temperature, an un-insulated conduit may freeze after only six minutes, whereas the illustrated conduit 136 and heater (i.e., "TNF HTR" embodiment) may last longer than fifty minutes before freezing.

Turning now to FIGS. 4A-D, an example of a controller 140 having an enclosure box 44 with a controller lid 40 and a battery compartment lid 42 is shown. The controller 140 may include a switch 142 to turn the controller 140 on and off and an LED 144 to indicate whether the controller is on or off. The sectional view of FIG. 5 demonstrates that the controller 140 may include a power source such as batteries 146 and a microprocessor circuit 148. The microcontroller circuit 148 may include a microprocessor (not shown) that receives a temperature signal from the temperature sensor, compares the temperature signal to a threshold, which may be either fixed or variable/programmable, and send/switch current from the batteries 146 to the heating element if the threshold is exceeded. The microcontroller circuit 148 can also include various other electrical components such as resistors, capacitors, etc., as needed to achieve the necessary operating voltages and currents.

Figure 6:
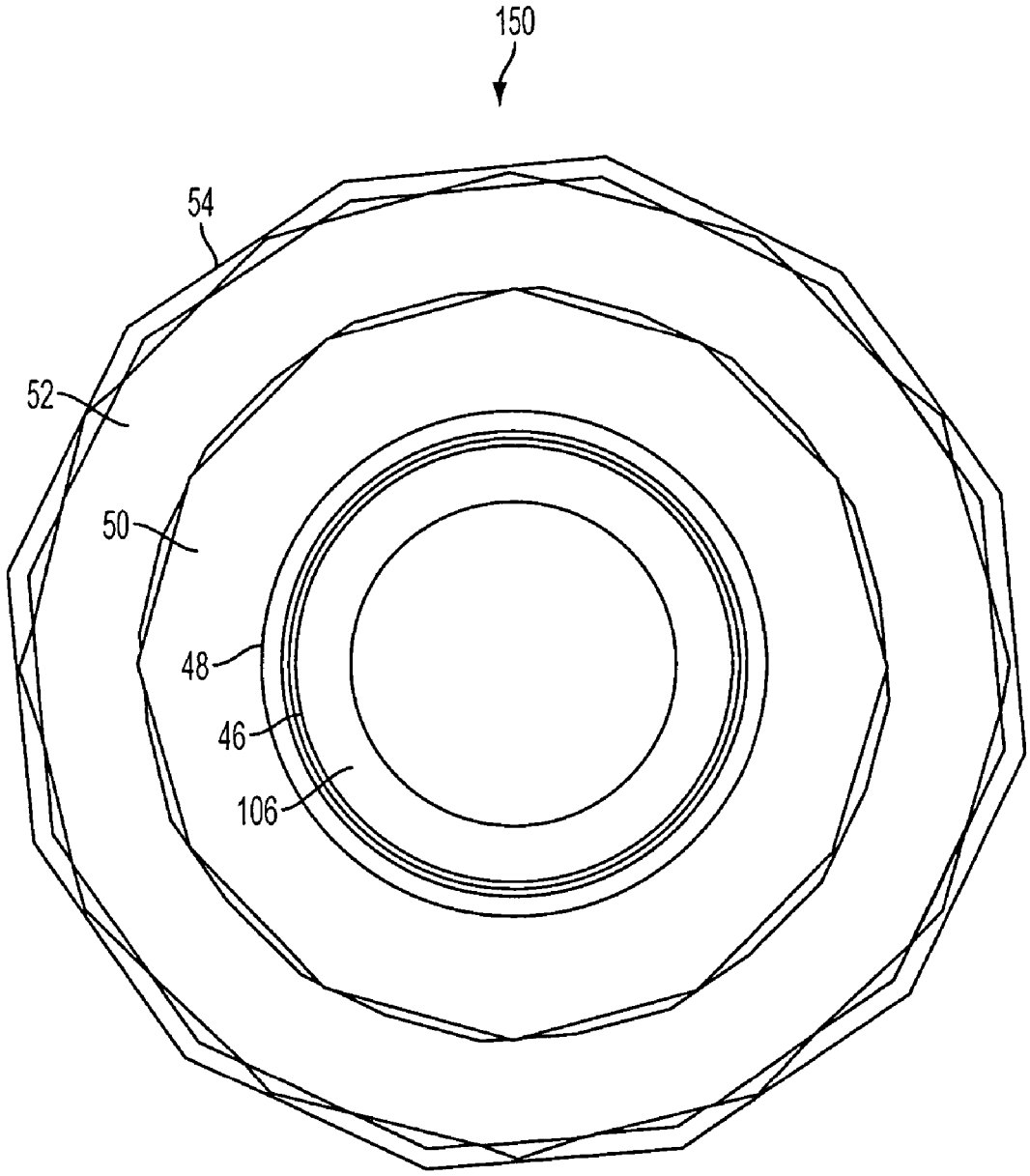
FIG. 6 is a sectional view of an example of a hose assembly according to an embodiment of the invention.

FIG. 6 shows a cross-sectional view of a conduit 106 that extends through an inner diameter of an active heating assembly so that the fluid in the conduit 106 is both insulated and serviced by the active heating assembly. Thus, in the example shown, a heating element 46 is disposed within the inner diameter of the sleeve and directly in contact with the conduit 106. In particular, the heating element 46 can be wrapped around the conduit 106, where in the illustrated example the heating element 46 is an array of Nichrome wires encased in a substrate such as tape. The tape can be used to immobilize the wires of the heating element 46 to ensure uniform heating of the conduit 106 even after multiple uses. The heating element 46 can be encased by a layer of waterproof breathable fabric such as nylon 48. The illustrated nylon 48 is highly water resistant and provides the heating element 46 with additional protection against rust/oxidation. The layer of nylon 48 may be padded with a layer of open cell foam 50 that is approximately ⅛" thick. The illustrated layer of foam 50 makes the assembly softer and provides more volume. The foam 50 may be enclosed by a layer of insulation 52 that can be approximately ¼" thick. The insulation 52 can have fine fibers that trap air and provide greater protection from the elements. In the illustrated example, a layer of fabric 54 is wrapped around the layer of insulation 52. The result is an assembly 150 that is extremely effective at keeping fluid within the conduit 106 from freezing. The assembly 150 can be fabricated by rolling the conduit 106 up in the remaining layers.

Figure 7A:
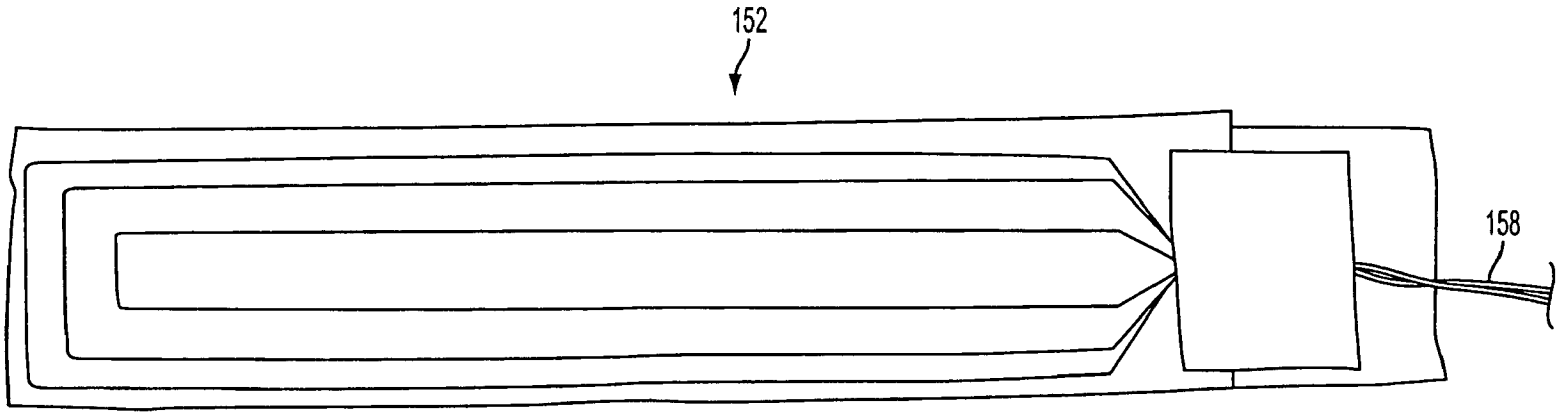
FIG. 7A is a top view of an example of a heating wire assembly according to an embodiment of the invention.
Figure 7C:
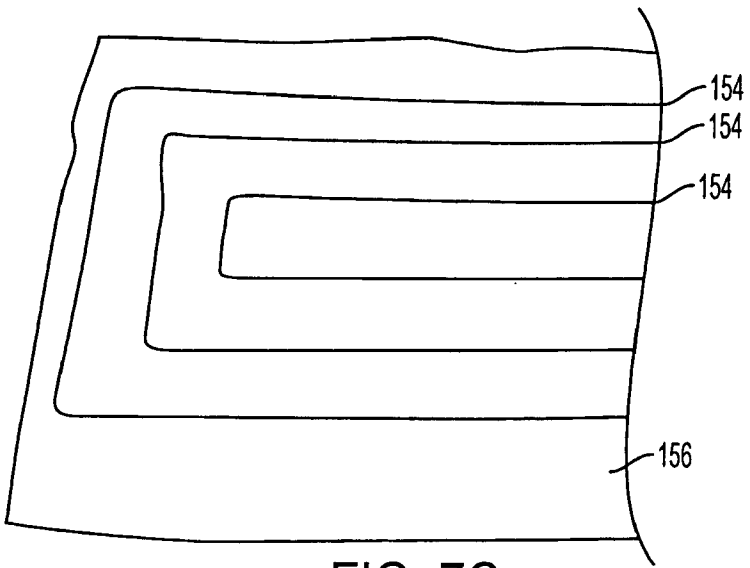
FIG. 7C is an enlarged top view of an example of a distal end of a heating wire assembly according to an embodiment of the invention.
Figure 7B:
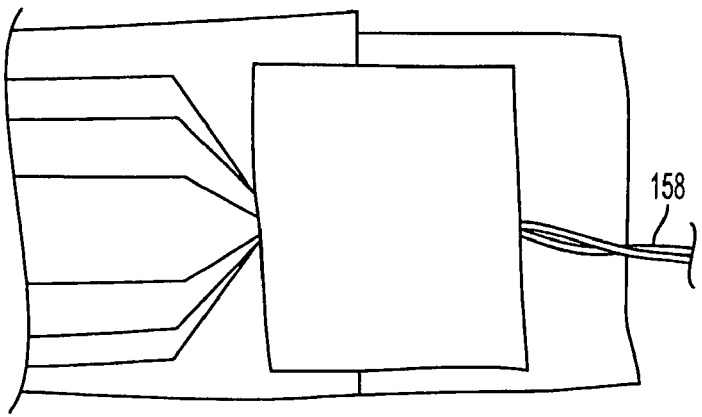
FIG. 7B is an enlarged top view of an example of a proximal end of a heating wire assembly according to an embodiment of the invention.

FIGS. 7A-7C show a heating element 152 that can be used to deliver heat to a conduit. In particular, the heating element 152 can include an array of wires 154 that are encased in a substrate such as tape 156, where the tape 156 immobilizes the wires 152. The wires 152 can be electrically connected to a controller such as the controllers already discussed via a pair of conductors 158, where the controller determines whether, and how much, current to feed through the wires 152 based on a temperature reading from a temperature sensor.

Figure 8:
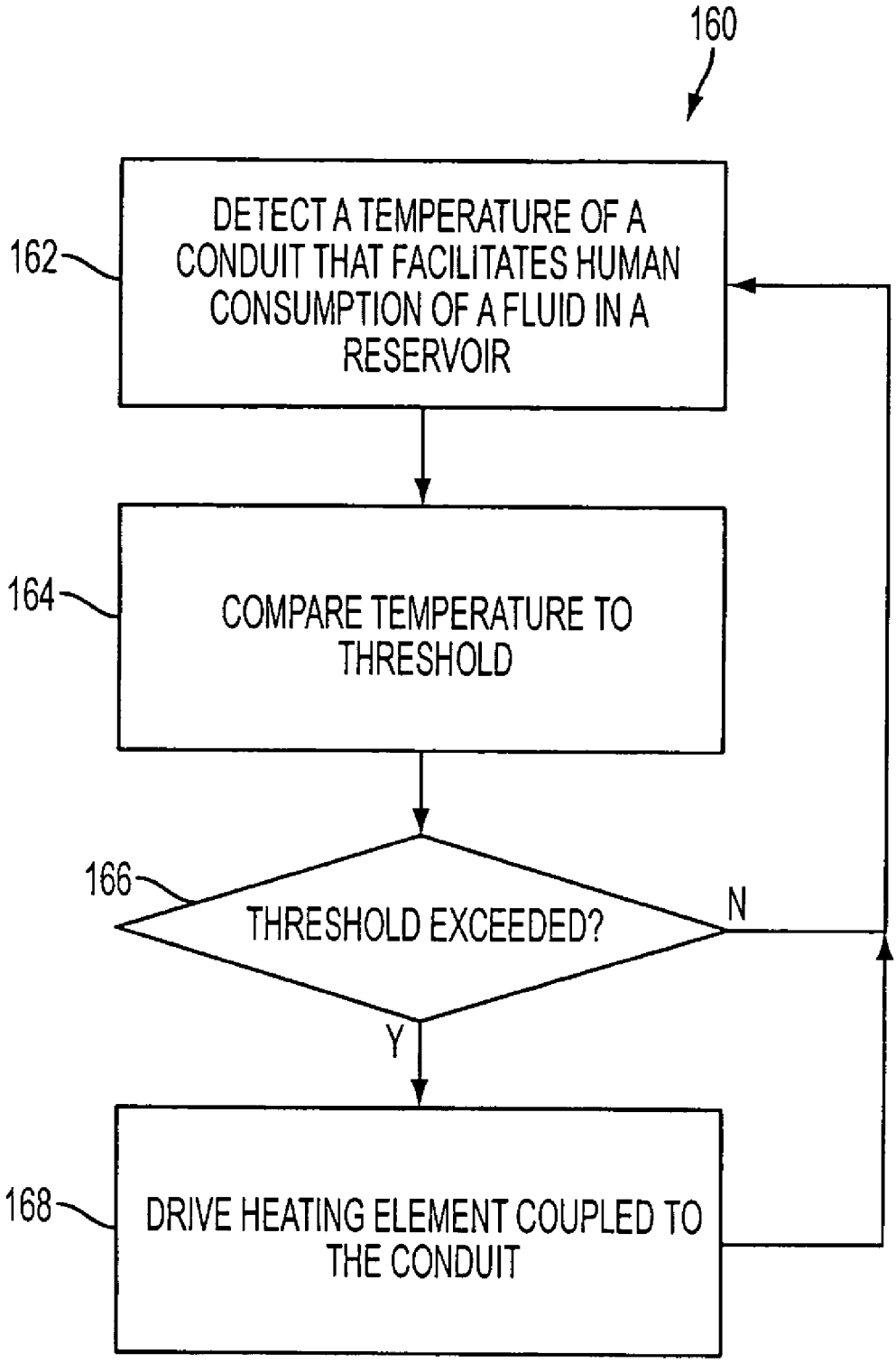
FIG. 8 is a flowchart of an example of a method of heating a supply conduit of a hydration pack according to an embodiment of the invention.

Turning now to FIG. 8, a method 160 of heating a supply conduit of a hydration pack is shown. The method 160 may be implemented using hardware, software, firmware, and any combination thereof. For example, the method 160 may be embodied as a set of instructions which, when executed by a processor, are operable to heat a fluid in a supply conduit and bite valve of a hydration pack. The instructions may be stored in a machine readable medium such as read only memory (ROM), random access memory (RAM), flash memory, etc. Alternatively, the method 160 may be embodied as fixed functionality hardware in an embedded microcontroller as is commonly used in the electronics industry.

In processing block 162 a temperature of a conduit that facilitates human consumption of a fluid in a reservoir is detected. Block 164 provides for comparing the temperature to a threshold. If it is determined at block 166 that the threshold has been exceeded, block 168 provides for driving a heating element disposed adjacent to and/or coupled to the conduit.

Terms such as "coupled", "attached", "connected" and "disposed adjacent" are used herein to refer to any type of relationship, direct or indirect, between the components in question, and may apply to electrical, mechanical, radio frequency (RF), remote, optical or other connections. In addition, the term "first", "second", and so on, are used herein only to facilitate discussion and do not necessarily infer any type of temporal or chronological relationship.

Those skilled in the art will appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claim.

We claim:

1. A portable hydration system comprising a carrying device including a first pouch, a second pouch, a first shoulder strap and a second shoulder strap, the first shoulder strap having a passageway;

a reservoir disposed within the first pouch; a conduit having a proximal end coupled to the reservoir;

a bite valve coupled to a distal end of the conduit; a temperature sensor to generate a temperature reading;

a heating element having an inner diameter, the conduit extending through the inner diameter of the heating element, a portion of the heating element and the conduit being disposed within the passageway and the bite valve being positioned at a front portion of the system;

a controller disposed within the second pouch, the controller to control the heating element based on the temperature reading; and an insulation sleeve having an inner diameter, the heating element being disposed within the insulation sleeve, and the conduit extending through the inner diameter of the insulation sleeve.

2. The system of claim 1, wherein the heating element includes a resistive material coupled to a substrate.

3. The system of claim 2, wherein the substrate includes a tape, the heating element including an array of wires encased in the tape.

4. The system of claim 1, wherein the insulation sleeve includes: a first layer of waterproof breathable fabric; a layer of padding disposed adjacent to the first layer; a layer of insulation disposed adjacent to the layer of padding; and a second layer of waterproof breathable fabric disposed adjacent to the layer of insulation.

5. The system of claim 1, wherein the temperature sensor is disposed adjacent to an outer surface of the conduit.

6. The system of claim 1, wherein the controller includes: a direct current (DC) power source; a microprocessor circuit to switch current from the DC power source to the heating element based on the temperature reading; and an indicator to indicate at least one of a DC power source battery life and a controller power on status.

7. The system of claim 6, wherein the microprocessor circuit is removably coupled to the indicator via an electrical connector.

8. The system of claim 1, wherein the controller is removably coupled to the heating element and the temperature sensor via an electrical connector.

9. A portable hydration system comprising:

a conduit coupled to a valve and a reservoir, the conduit and the valve to facilitate human consumption of fluid in the reservoir; and an active heating assembly to prevent the fluid from freezing while in the conduit and the valve;

wherein the active heating assembly includes:

a temperature sensor to generate a temperature reading;

a heating element disposed adjacent to the conduit; and a controller to control the heating element based on the temperature reading, wherein the heating element includes a wire coupled to a substrate with an inner diameter, the conduit extending through the inner diameter of the substrate, and an insulation sleeve having an inner diameter, the wire coupled to the substrate being disposed within the insulation sleeve, and the conduit extending through the inner diameter of the insulation sleeve.

10. The system of claim 9, wherein the temperature sensor is disposed adjacent to an outer surface of the conduit.

11. The system of claim 9, wherein the controller includes:

a direct current (DC) power source;

a microprocessor circuit to switch current from the DC power source to the heating element based on the temperature reading; and an indicator to indicate at least one of a DC power source battery life and a power on status of the controller.

12. The system of claim 11, wherein the microprocessor circuit is removably coupled to the indicator via an electrical connector.

13. The system of claim 9, wherein the controller is removably coupled to the heating element and the temperature sensor via an electrical connector.

14. The system of claim 9, further including a carrying device having a pouch and a shoulder strap with a passageway, the reservoir being disposed within the pouch and the conduit extending through the passageway to a front portion of the system.

* * * * *